US010766159B2

(12) United States Patent
Li

(10) Patent No.: US 10,766,159 B2
(45) Date of Patent: Sep. 8, 2020

(54) MANUAL CRAFT CUTTING MACHINE

(71) Applicant: PARRIC NINGBO STATIONERY AND GIFTS MFG. CO., LTD, Ningbo (CN)

(72) Inventor: Fuping Li, Ningbo (CN)

(73) Assignee: PARRIC NINGBO STATIONARY AND GIFTS MFG. CO., LTD. (CN)

( * ) Notice: Subject to any disclaimer, the term of this patent is extended or adjusted under 35 U.S.C. 154(b) by 0 days.

(21) Appl. No.: 15/753,085

(22) PCT Filed: Aug. 22, 2017

(86) PCT No.: PCT/CN2017/098486

§ 371 (c)(1),
(2) Date: Feb. 15, 2018

(87) PCT Pub. No.: WO2018/040984

PCT Pub. Date: Mar. 8, 2018

(65) Prior Publication Data

US 2019/0202077 A1 Jul. 4, 2019

(30) Foreign Application Priority Data

Aug. 31, 2016 (CN) ..... 2016 1 0795979

(51) Int. Cl.
*B31F 1/07* (2006.01)
*B44B 5/00* (2006.01)
(Continued)

(52) U.S. Cl.
CPC ..... *B26D 7/265* (2013.01); *B26F 1/44* (2013.01); *B31F 1/07* (2013.01); *B44B 5/00* (2013.01);
(Continued)

(58) Field of Classification Search
CPC ... B26D 5/10; B26D 7/265; B26F 1/44; B26F 1/384; B26F 1/42; B31F 1/07;
(Continued)

(56) References Cited

U.S. PATENT DOCUMENTS 1,660,978 A * 2/1928 Speed ..... D21G 1/00 101/23
3,264,978 A 8/1966 Staley
(Continued)

FOREIGN PATENT DOCUMENTS

CN 2770998 Y 4/2006
CN 201172352 Y 12/2008
(Continued)

OTHER PUBLICATIONS

International Search Report (ISR) for PCT/CN2017/098486 dated Oct. 12, 2017, pp. 1-5.
(Continued)

*Primary Examiner* — Leslie J Evanisko
*Assistant Examiner* — Marissa Ferguson-Samreth
(74) *Attorney, Agent, or Firm* — McDonnell Boehnen Hulber & Berghoff LLP

(57) ABSTRACT

A manual craft cutting machine comprises a housing, a template, a press roller, a retainer, a backing plate, and a drive mechanism. The press roller is composed of a first press roller and a second press roller. The press roller is rotated under restriction of the retainer. The retainer comprises a positioning retainer and a sliding retainer. The positioning retainer is provided with a slide groove. The sliding retainer is inserted in the slide groove and movable along the slide groove. The sliding retainer comprises a first sliding retainer rotatably connected with the first press roller and a second sliding retainer rotatably connected with the second press roller. The manual craft cutting machine further
(Continued)

comprises a press roller spacing adjustment mechanism. The press roller spacing adjustment mechanism comprises a shift adjusting mechanism for adjusting a large spacing between the press rollers and a fine adjustment mechanism for adjusting a fine spacing between the press rollers. The shift adjustment mechanism drives the first sliding retainer to move along the slide groove, and the fine adjustment mechanism drives the second sliding retainer to move along the slide groove, so that the spacing between the press rollers can be quickly and largely adjusted according to the needs, and a fine spacing adjustment can be achieved according to the needs.

19 Claims, 8 Drawing Sheets

(51) Int. Cl.

| | |
|---|---|
| ***B26D 7/26*** | (2006.01) |
| ***B44B 5/02*** | (2006.01) |
| ***B26F 1/44*** | (2006.01) |
| *B27J 5/00* | (2006.01) |

(52) U.S. Cl.
CPC . *B44B 5/02* (2013.01); *B27J 5/00* (2013.01); *B44B 5/0057* (2013.01); *B44B 5/0085* (2013.01)

(58) Field of Classification Search
CPC ..... B31F 2201/0715; B44B 5/00; B44B 5/02; B44B 5/0009; B44B 5/0052; B44B 5/0057; B44B 5/0085; B27J 5/00
See application file for complete search history.

(56) References Cited

U.S. PATENT DOCUMENTS

| | | | | |
|---|---|---|---|---|
| 4,732,082 | A * | 3/1988 | Ireton | B21D 17/04 101/23 |
| 7,546,800 | B2 * | 6/2009 | Caron | B26F 1/42 101/16 |
| 2005/0253324 | A1 * | 11/2005 | Corcoran | B26F 1/42 271/15 |
| 2006/0272520 | A1 * | 12/2006 | Nottingham | B31F 1/07 101/24 |
| 2007/0214972 | A1 * | 9/2007 | Ayala | B26F 1/42 100/176 |
| 2011/0252939 | A1 * | 10/2011 | Nabity | B26F 1/384 83/859 |
| 2014/0283697 | A1 * | 9/2014 | Lu | B31F 1/07 101/23 |
| 2016/0121502 | A1 * | 5/2016 | Carey | B26D 5/10 101/32 |

FOREIGN PATENT DOCUMENTS

| | | | |
|---|---|---|---|
| CN | 105015241 | A | 11/2015 |
| CN | 106183583 | A | 12/2016 |
| CN | 205989604 | U | 3/2017 |

OTHER PUBLICATIONS

Written Opinion of the International Searching Authority for PCT/CN2017/098486 dated Oct. 12, 2017, pp. 1-5.

* cited by examiner

--Prior Art--

--Prior Art--

MANUAL CRAFT CUTTING MACHINE

CROSS-REFERENCE TO RELATED APPLICATION

This application is a U.S. national phase of International Application No. PCT/CN2017/098486, filed on Aug. 22, 2017, which claims priority to Chinese Patent Application No. 201610795979.5, filed on Aug. 31, 2016 and Chinese Patent Application No. 201621025280.2, filed on Aug. 31, 2016, all of which are incorporated by reference herein in their entirety.

FIELD OF THE INVENTION

The present invention relates to a pattern embossing or cutting tool, and more particularly to a manual craft cutting machine for pattern making on a pattern medium, such as paper, non-woven fabric, plastic sheet, cork, foil, leather, EVA, and the like.

BACKGROUND OF THE INVENTION

A conventional manual embossing or cutting tool for pattern making on the surface of a pattern medium such as paper generally includes a housing, a template, a press roller, a backing plate, and a drive mechanism. The template includes a pair of upper and lower templates. The pattern medium is sandwiched between the two templates. The upper template and the lower template are provided with concave and convex patterns which match with each other. The concave and convex patterns may be through cutting structures, or may be non-through embossing structures to abut against each other. The press roller is usually composed of a pair of press rollers. In complex cases can use more than one pair of press rollers. A retainer is provided at both ends of the press roller. The press roller is rotated under restriction of the retainer. The press roller is driven by the drive mechanism to rotate. The backing plate is composed of a pair of backing plates attached to each other and sandwiched between the press rollers. The template and the pattern medium are sandwiched between the backing plates. When the press rollers are rotated, the press rollers drive the backing plates to pass through the rolling surfaces of the press rollers. After the template is pressed by the press rollers, the pattern medium between the templates is pressed to generate a template pattern. The drive mechanism comprises a handle, a gear set, and a transmission shaft. When the handle is rotated, the gear set is driven to rotate with the preset gear ratio, and the gear set drives the press rollers to rotate.

The disadvantages of the prior art are as follows: the stress between the press rollers usually reaches 600 kg, and the retainer is under great stress. Therefore, the retainer is fastened in the housing by using a fixed structure. When different patterns are made and different pattern mediums are used, it is required to use various backing plates in different thicknesses. This needs to store a large number of backing plates in different thicknesses. The cost is high, and it is inconvenient for operation, and the working efficiency is low. Moreover, in many cases, the thickness of the template and the pattern medium is very thin. The thickness of a different backing plate cannot meet the requirement. It is necessary to use a pluggable backing plate. The pluggable backing plate is also very thin. In actual use, it is necessary to test repeatedly to decide the number of layers, so the working efficiency is very low.

The information disclosed in this background is only for understanding of the general background of the invention and should not be taken as an acknowledgment or any form of suggestion that this information constitutes the prior art that is already known in this field to a person skilled in the art.

SUMMARY OF THE INVENTION

The primary object of the present invention is to provide a manual craft cutting machine capable of adjusting the spacing between press rolls according to the specific needs of a pattern medium and pattern making to improve the efficiency of the pattern making and to reduce the cost of the production tool and to improve the cleanness of the production environment.

In order to achieve the aforesaid object, the manual craft cutter of the present invention comprises a housing, a template, a press roller, a retainer, a backing plate, and a drive mechanism. The template includes a pair of upper and lower templates. A pattern medium is sandwiched between the upper and lower templates. The upper template and the lower template are provided with concave and convex patterns which match with each other. The concave and convex patterns may be through cutting structures, or may be non-through embossing structures to abut against each other. One of the upper and lower templates may be a smooth plate not having a pattern. The press roller is composed of a pair of a first press roller and a second press roller. More than one pair of press rollers may be used in special situations. The press rollers are disposed axially parallel to each other. Two ends of the press roller form a roller axle or extend in an axial direction of the press roller to form the roller axle. The roller axle is confined by the retainer. The press roller is rotated under restriction of the retainer. The backing plate is composed of a pair of backing plates attached to each other and sandwiched between the press rollers. The template is sandwiched between the backing plates. When the press rollers are rotated, the press rollers drive the backing plates to pass through the rolling surfaces of the press rollers. After the template is pressed by the press rollers, the pattern medium between the templates is pressed to generate a template pattern. Wherein, the retainer comprises a positioning retainer and a sliding retainer. The positioning retainer is tightly connected with the housing and disposed at the two ends of the press roller. The positioning retainer is provided with a slide groove. The sliding retainer is inserted in the slide groove and movable along the slide groove. The sliding retainer comprises a first sliding retainer rotatably connected with the first press roller and a second sliding retainer rotatably connected with the second press roller. The drive mechanism includes a handle and a gear set. The gear set includes a speed reduction gear set and a constant speed gear set. The speed reduction gear set includes a handle gear, a speed reduction gear or the speed reduction gear set to mesh with each other. The handle gear is rotated along with the handle. The speed reduction gear is connected with the first press roller or the second press roller to drive one of the two press rollers to rotate. The constant speed gear set includes a pair of a first constant speed gear and a second constant speed gear to mesh with each other. The constant speed gears are fixed on the roller axles of the first press roller and the second press roller, respectively. When one of the press rollers is driven by the speed reduction gear to rotate, the other press roller is driven by the first constant speed gear or the second constant speed gear to rotate at a constant speed. The manual craft cutter further comprises a press roller spacing adjustment mechanism. The press roller spacing adjustment mechanism comprises a shift adjusting mechanism for adjusting a large spacing between the press rollers and a fine adjustment mechanism for adjusting a fine spacing between the press rollers. The shift adjustment mechanism drives the first sliding retainer to move along the slide groove, and the fine adjustment mechanism drives the second sliding retainer to move along the slide groove, so that the spacing between the press rollers can be quickly and largely adjusted according to the needs, and a fine spacing adjustment can be achieved depending on the spacing between the temples and the stress requirement.

In the aforesaid technical solution, preferably, the shift adjustment mechanism includes a shift adjustment knob, a shift adjustment shaft, and a shift driving key. The shift adjustment shaft is parallel to the first press roller. The shift driving key is fitted and fixed on two ends of the shift adjustment shaft and rotated along with the shift adjustment shaft. The shift driving key has shift key surfaces. The number of the shift key surfaces is two or more than two. Axial distances between the different shift key surfaces and the shift adjustment shaft are different, corresponding to the change of the distance between the press rollers. The first sliding retainer at two ends of the first press roller is provided with a corresponding shift driven key. The shift driven key has a corresponding shift driven key surface. When the shift adjustment knob is rotated, the shift adjustment shaft is driven to rotate. Abutting surfaces of the shift key surface and the shift driven key surface generate a change to adjust the spacing between the press rollers.

In the aforesaid technical solution, preferably, a shift adjustment shaft support seat is provided between the two ends of the shift adjustment shaft, so that the shift adjustment shaft does not bend due to excessive stress when the press rollers are working.

In the aforesaid technical solution, preferably, the shift driven key is separately provided and embedded in a surface of the first sliding retainer, which may be made of a hard wear-resistant material independently so as to ensure the rigidity and wear resistance of the shift driven key surface and reduce the material requirements of the entire first sliding retainer to reduce the cost.

In the aforesaid technical solution, preferably, the positioning retainer is a paired housing structure, side walls at both sides of the housing structure are vertical structures. The side walls form the slide groove, which can reduce the complexity of the structure of the retainer.

In the aforesaid technical solution, preferably, a return spring is provided between the positioning retainer and the first sliding retainer, so that the shift key surface and the shift driven key surface are always in stable contact with each other.

In the aforesaid technical solution, preferably, the fine adjustment mechanism includes a fine adjustment knob, a fine adjustment shaft, and a fine adjustment turning wheel. The fine adjustment shaft is parallel to the second press roller. The fine adjustment turning wheel is sleeved and fixed on two ends of the fine adjustment shaft and rotated along with the fine adjustment shaft. A center axis of the fine adjustment turning wheel is deviated from an axis of the fine adjustment shaft. The deviated distance corresponds to the fine adjustment distance of the press rollers. The second sliding retainer is provided with a fine adjustment tuning wheel hole for mounting the fine adjustment tuning wheel. The fine adjustment shaft is driven by the fine adjustment knob to rotate. The fine adjustment tuning wheel drives the second sliding retainer to move, corresponding to the slight distance change between the press rollers.

In the aforesaid technical solution, preferably, the fine adjustment mechanism further includes a fine adjustment gear set. The fine adjustment gear set includes a pair of a fine adjustment gear and a fine adjustment pinion to mesh with each other. The fine adjustment gear is fixedly connected with the fine adjustment shaft. The fine adjustment pinion is connected with the housing or the positioning retainer, so that the fine adjustment knob reduces the force when the fine adjustment shaft is driven, thereby improving the feeling of fine adjustment.

In the aforesaid technical solution, preferably, a fine adjustment shaft support seat is provided between the two ends of the fine adjustment shaft, so that the fine adjustment shaft does not bend due to excessive stress when the press rollers are working.

In the aforesaid technical solution, preferably, the fine adjustment knob is provided with a locking gear. A sleeve is axially disposed on the locking gear. One end of the sleeve is axially connected to the fine adjustment knob. An axle of the fine adjustment pinion is fitted in the sleeve. The fine adjustment pinion and the locking gear are coaxially connected. The housing or the positioning retainer is provided with a fine adjustment locking groove. The fine adjustment locking groove has a shape matched with the locking gear. A push spring is provided in the sleeve. When the fine adjustment knob is adjusted, the fine adjustment knob compresses the push spring and the fine adjustment knob pushes the locking gear to move axially, so that the locking gear is detached from the fine adjustment locking groove to be unlocked. At this time, the fine adjustment shaft can be rotated to adjust the second press roller. When the adjustment is completed, the fine adjustment knob is released. Under the driving force of the push spring, the locking gear slides axially along with the fine adjustment knob and is inserted in the fine adjustment locking groove again so that the second press roller is kept in a locked state.

In the aforesaid technical solution, preferably, the gears of the speed reduction gear set and the constant speed gear set are formed by stamping a thin metal plate. The thickness of the gear can be achieved by means of superimposing and connecting as needed so that the cost of the gear can be lowered while meeting performance requirements.

In the aforesaid technical solution, preferably, two sides of the housing are provided with conveying plates. The conveying plates are rotatably connected with the housing. In a working state, the conveying plates are unfolded to hold the backing plates. In a non-working state, the conveying plates are folded to abut against the housing.

In the aforesaid technical solution, preferably, a bottom of the housing is provided with support legs. The support legs each include a suction cup that can be moved up and down. An upper portion of the suction cup is fixedly connected with a connecting seat. The connecting seat is disposed inside the housing. One end of the connecting seat is provided with a shaft hole. The shaft hole is provided with a camshaft. The conveying plates are rotatably connected to the housing through the camshaft. The connecting seat and the suction cup are moved up and down along with rotation of the camshaft. In a working state, the conveying plate is turned to a horizontal position, and the camshaft presses the connecting seat downward, so that the suction cup is firmly adhered to the ground to improve the working stability of the apparatus. When not in use, the conveying plate is turned from the horizontal position to a vertical position, and the camshaft is rotated to move the connecting seat upward, such that the suction cup is moved away the ground to lift the apparatus conveniently.

In the aforesaid technical solution, preferably, the handle gear is provided with a connecting shaft which is fitted and fixed to the handle. A side wall of the connecting shaft is provided with an annular engaging groove. The handle is provided with an axial locking device to be engaged with the annular engaging groove. The axial locking device comprises an engaging plate which is inserted into and removed from the annular engaging groove and a push button for controlling movement of the engaging plate. The push button is disposed on an outer wall of the handle and can be moved back and forth. By sliding the push button, the handle can be axially locked to the connecting shaft and unlocked from the connecting shaft, which facilitates the disassembly and assembly of the handle.

In the aforesaid technical solution, preferably, the handle has a positioning groove therein. The engaging plate is moved back and forth within the positioning groove. A baffle perpendicular to the direction of movement of the engaging plate is provided in the positioning groove. A restoring spring is provided between the engaging plate and the baffle. In a natural state, the engaging plate is engaged with the annular engaging groove.

In the aforesaid technical solution, the shift adjustment mechanism includes a shift adjustment knob, a shift adjustment shaft, and a shift driving key. The shift adjustment shaft is parallel to the first press roller. The shift driving key is fitted and fixed on two ends of the shift adjustment shaft and rotated along with the shift adjustment shaft. The shift driving key has more than two shift key surfaces. Axial distances between the different shift key surfaces and the shift adjustment shaft are different. The first sliding retainer at two ends of the first press roller is provided with a corresponding shift driven key. The shift driven key has a shift driven key surface. When the shift adjustment knob is rotated, the shift adjustment shaft is driven to rotate. Abutting surfaces of the shift key surface and the shift driven key surface generate a change.

In the aforesaid technical solution, preferably, the fine adjustment mechanism further includes a fine adjustment gear set. The fine adjustment gear set includes a pair of a first adjustment gear and a second adjustment gear to mesh with each other. The first fine adjustment gear is fixedly connected with the fine adjustment shaft. The second adjustment gear is connected with the housing or the positioning retainer.

In order to achieve the aforesaid object, the present invention provides a manual craft cutting machine, comprising a housing, a press roller, a retainer, and a drive mechanism. The press roller is composed of a pair of a first press roller and a second press roller. The press rollers are disposed axially parallel to each other. Two ends of the press roller form a roller axle or extending in an axial direction of the press roller to form the roller axle. The roller axle is confined by the retainer.

The retainer comprises a positioning retainer and a sliding retainer. The positioning retainer is tightly connected with the housing. The positioning retainer is provided with a slide groove. The sliding retainer is inserted in the slide groove and movable along the slide groove. The sliding retainer comprises a first sliding retainer rotatably connected with the first press roller and a second sliding retainer rotatably connected with the second press roller.

The drive mechanism includes a handle and a gear set. The gear set includes a speed reduction gear set and a constant speed gear set. The speed reduction gear set includes a handle gear and a speed reduction gear to mesh with each other. The handle gear is rotated along with the handle. The speed reduction gear is connected with the first press roller or the second press roller to drive one of the two press rollers to rotate. The constant speed gear set includes a pair of a first constant speed gear and a second constant speed gear to mesh with each other. The constant speed gears are fixed on the roller axles of the first press roller and the second press roller, respectively. When one of the press rollers is driven by the speed reduction gear to rotate, the other press roller is driven by the first constant speed gear or the second constant speed gear to rotate at a constant speed.

The manual craft cutting machine further comprises a press roller spacing adjustment mechanism. The press roller spacing adjustment mechanism comprises a shift adjusting mechanism for adjusting a large spacing between the press rollers and a fine adjustment mechanism for adjusting a fine spacing between the press rollers. The shift adjustment mechanism drives the first sliding retainer to move along the slide groove. The fine adjustment mechanism drives the second sliding retainer to move along the slide groove.

In the aforesaid technical solution, a plurality of templates arranged in pairs are sandwiched between the press rollers. A pattern is provided on the templates. A pattern medium is sandwiched between the adjacent templates. The plurality of templates arranged in pairs are sandwiched between the press rollers. More than one pair of templates are superimposed each other, or only two templates are superimposed to meet a variety of usage.

In the aforesaid technical solution, a plurality of templates and backing plates attached to each other are sandwiched between the press rollers. The templates are provided with patterns thereon. At least one template and at least one backing plate are provided. The pattern medium is attached to at least one of the templates. The aforesaid technical solution includes the case of one template and one backing plate, the case of two templates and one backing plates, and the case of one template and two backing plates to meet various uses and good adaptability. When there is only one template and one backing plate, the pattern medium is located between the template and the backing plate. When there are two templates and one backing plate, the pattern medium is located between the two templates, and the backing plate is located outside the two templates and attached to one of the templates. When there is one template and two backing plates, the pattern media is attached to the template and located between the two backing plates.

Compared with the prior art, the present invention is provided with the positioning retainer, the sliding retainer, the shift adjustment mechanism and the fine adjustment mechanism. The press rollers are fixed on the sliding retainer, and the spacing between the press rollers can be adjusted through the shift adjustment mechanism and the fine adjustment mechanism to meet the specific requirements of various pattern mediums and pattern making, improving the efficiency of pattern making, reducing the cost of production tools, and improving the cleanness of the production environment.

Figure 1:
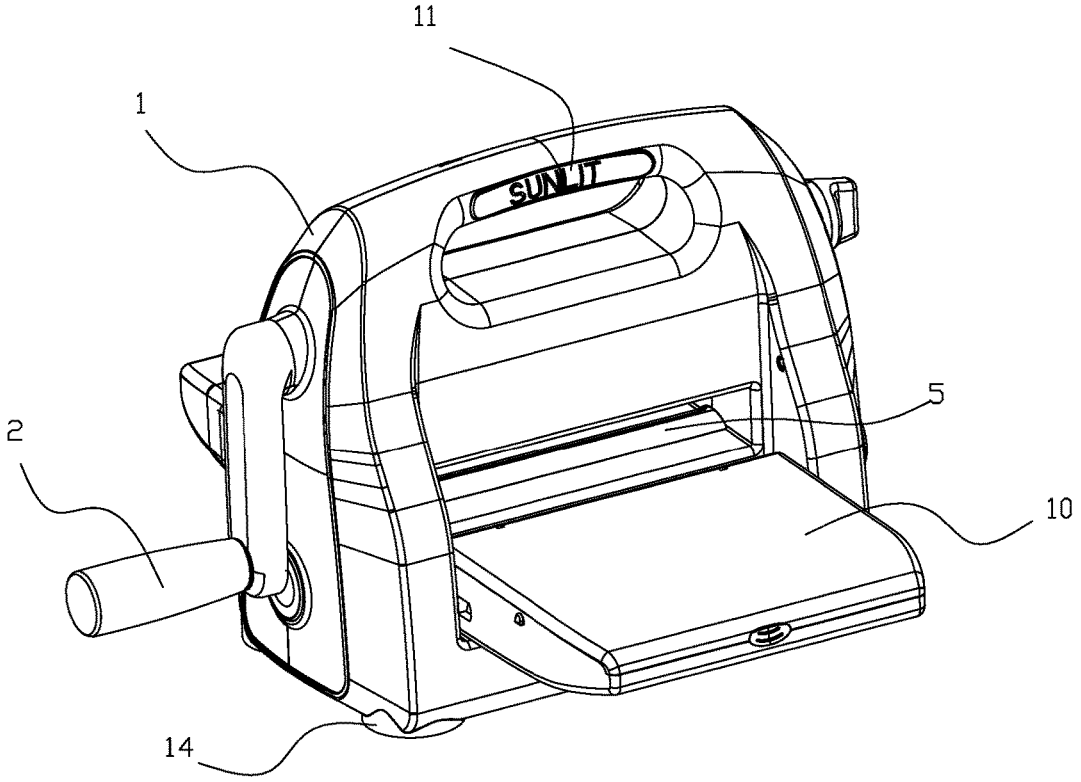
FIG. 1 is a perspective view of a conventional manual craft cutting machine (seen from the direction of the handle)

DESCRIPTION OF REFERENCE NUMBERS OF THE ACCOMPANYING DRAWINGS (1) housing; (11) handle; (12) first press roller hole; (13) second press roller hole; (14) support leg; (2) handle; (3) positioning retainer; (31) first sliding retainer; (32) second sliding retainer; (321) fine adjustment turning wheel hole; (33) shift driven key; (34) return spring: (4) first press roller; (41) roller axle; (5) second press roller; (6) speed reduction gear set; (61) handle gear; (62) first speed reduction gear; (63) second speed reduction gear; (7) constant speed gear set; (71) first constant speed gear; (72) second constant speed gear; (8) shift adjustment knob; (81) shift adjustment shaft; (82) shift adjustment shaft support bearing; (83) bearing seat; (84) shift driving key; (841) shift key surface; (9) fine adjustment knob; (91) fine adjustment pinion; (92) fine adjustment gear; (93) locking gear; (931) sleeve; (94) push spring; (95) fine adjustment shaft; (96) fine adjustment shaft support bearing; (97) bearing seat; (98) fine adjustment turning wheel; (10) conveying plate; (101) connecting seat; (102) shaft hole; (103) camshaft; (104) connecting shaft; (105) annular engaging groove; (106) axial rib; (107) engaging plate; (108) push button; (109) positioning groove; (110) baffle; (111) restoring spring; (112) protrusion; (113) engaging recess; (114) buckle hole; (115) buckle; (1151) gear rack; (116) gear shaft

DESCRIPTION OF THE PREFERRED EMBODIMENTS

Embodiments of the present invention will now be described, by way of example only, with reference to the accompanying drawings. It should be understood that these embodiments are only for further description of the present invention, and are not intended to limit the scope of the present invention.

Unless otherwise explicitly stated, throughout the specification and claims, the terms "comprises" and its variation such as "comprising" or "including" used herein specify the presence of stated features or components, but do not preclude the presence or addition of one or more other features or components.

As shown in FIGS. 1, 2, 3, 4, and 5, a manual craft cutting machine comprises a housing 1, a template, a press roller, a retainer, a backing plate, and a drive mechanism. The housing 1 is composed of two thin housing to mate with each other. The upper portion of the housing is provided with a handle 11, which facilitates the handling of the whole device. The bottom of the housing 1 is provided with support legs 14 with a variable height. The template (not shown in the figures) includes a pair of upper and lower templates. A pattern medium (not shown in the figures) is sandwiched between the upper and lower templates. The upper template and the lower template are provided with concave and convex patterns which match with each other. The concave and convex patterns may be through cutting structures, or may be non-through embossing structures to abut against each other. One of the upper and lower templates may be a smooth plate not having a pattern. The press roller is composed of a pair of a first press roller 4 and a second press roller 5 (more than one pair of press rollers may be used in special situations). The press rollers are disposed axially parallel to each other. Two ends of the press roller form a roller axle or extend in the axial direction of the press roller to form the roller axle 41. The backing plate (not shown in the figures) is composed of a pair of backing plates attached to each other and sandwiched between the press rollers. The template is sandwiched between the backing plates. When the press rollers are rotated, the press rollers drive the backing plates to pass through the rolling surfaces of the press rollers. After the template is pressed by the press rollers, the pattern medium between the templates is pressed to generate a template pattern. Two sides of the housing 1 are provided with conveying plates 10. The conveying plates 10 are rotatably connected with the housing 1. When unfolded, the backing plates are placed on the conveying plates 10 and conveyed by the press rollers. In a non-working state, the conveying plates 10 are folded to abut against or close to the housing 11. The retainer comprises a positioning retainer 3 and a sliding retainer. The positioning retainer 3 is a paired housing structure. The side walls at both sides of the housing structure are vertical structures. The positioning retainer 3 is tightly connected with the housing 1 and disposed at the two ends of the press roller. The positioning retainer is provided with a slide groove. The slide groove is formed by the vertical side walls of the positioning retainer 3. The sliding retainer is inserted in the slide groove and moved along the slide groove. The sliding retainer comprises a first sliding retainer 31 rotatably connected with the first press roller 4 and a second sliding retainer 32 rotatably connected with the second press roller 5. The drive mechanism includes a handle 2 and a gear set. The gear set includes a speed reduction gear set 6 and a constant speed gear set 7. The speed reduction gear set 6 includes a handle gear 61 and a speed reduction gear set (or a single speed reduction gear) to mesh with each other. The speed reduction gear set includes a first reduction gear 62 and a second speed reduction gear 63. The handle gear 61 is rotated along with the handle 2. The second speed reduction gear 63 is connected with the second press roller 5 (in a different design, it may be connected with the first press roller 4) to drive the second press roller 5 to rotate. The constant speed gear set 7 includes a pair of a first constant speed gear 71 and a second constant speed gear 72 which are meshed with each other. The first constant speed gear and the second constant speed gear are fixed on the roller axles of the first press roller 4 and the second press roller 5, respectively. When the second press roller 5 is driven by the second speed reduction gear 63 to rotate, the first press roller 4 is driven by the first constant speed gear 71 to rotate at a constant speed. The present invention further comprises a press roller spacing adjustment mechanism. The press roller spacing adjustment mechanism comprises a shift adjusting mechanism for adjusting a large spacing between the press rollers and a fine adjustment mechanism for adjusting a fine spacing between the press rollers. The shift adjustment mechanism drives the first sliding retainer 31 to move along the slide groove, and the fine adjustment mechanism drives the second sliding retainer 32 to move along the slide groove, so that the spacing between the press rollers can be quickly and largely adjusted according to the needs, and a fine spacing adjustment can be achieved depending on the spacing between the temples and the stress requirement. The housing 1 is provided with a first press roller hole 12 and a second press roller hole 13 corresponding in position to the press rollers. The diameter of the first press roller hole 12 is greater than or equal to the sum of the diameter of the first press roller 4 and the shift adjustment displacement. The diameter of the second press roller hole 13 is greater than or equal to the sum of the diameter of the second press roller 5 and the fine adjustment displacement such that the adjustment of the press rollers is not affected by the housing 1.

As shown in FIGS. 2, 3, 4, and 5, the shift adjustment mechanism includes a shift adjustment knob 8, a shift adjustment shaft 81, and a shift driving key 84. The shift adjustment shaft 81 is parallel to the first press roller 4. The shift driving key 84 is fitted and fixed on two ends of the shift adjustment shaft 81 and rotated along with the shift adjustment shaft 81. The shift driving key 84 has shift key surfaces 841. The number of the shift key surfaces 841 is usually two (or more than two). The axial distances between the different shift key surfaces 841 and the shift adjustment shaft 81 are different, corresponding to the change of the distance between the press rollers. The first sliding retainer 31 at the two ends of the first press roller 4 is provided with a corresponding shift driven key 33. The shift driven key 33 has a corresponding shift driven key surface. When the shift adjustment knob 8 is rotated, the shift adjustment shaft 81 is driven to rotate. The abutting surfaces of the shift key surface 841 and the shift driven key surface generate a change to adjust the spacing between the press rollers. The shift driven key 33 is separately provided and embedded in the surface of the first sliding retainer 3, which may be made of a hard wear-resistant material independently so as to ensure the rigidity and wear resistance of the shift driven key surface and reduce the material requirements of the entire first sliding retainer 31 to reduce the cost.

Figure 2:
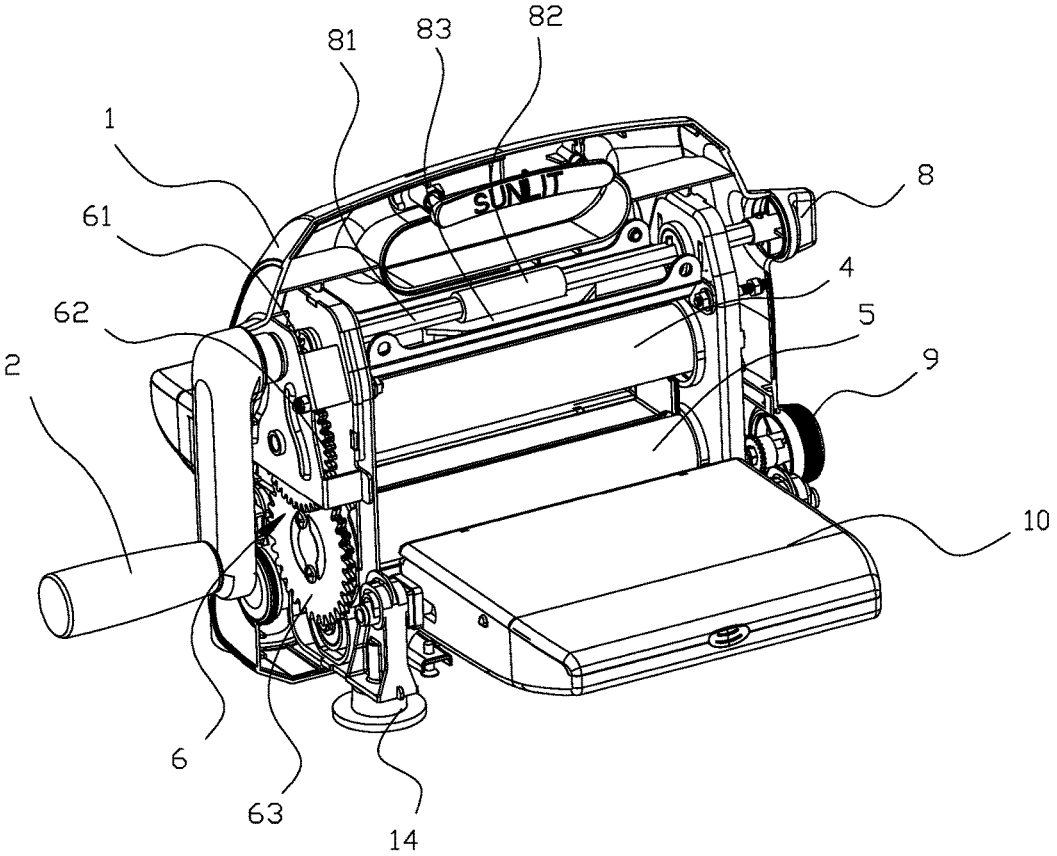
FIG. 2 is a perspective view of the conventional manual craft cutting machine (seen from the direction of the handle, a half of the housing is removed)
Figure 3:
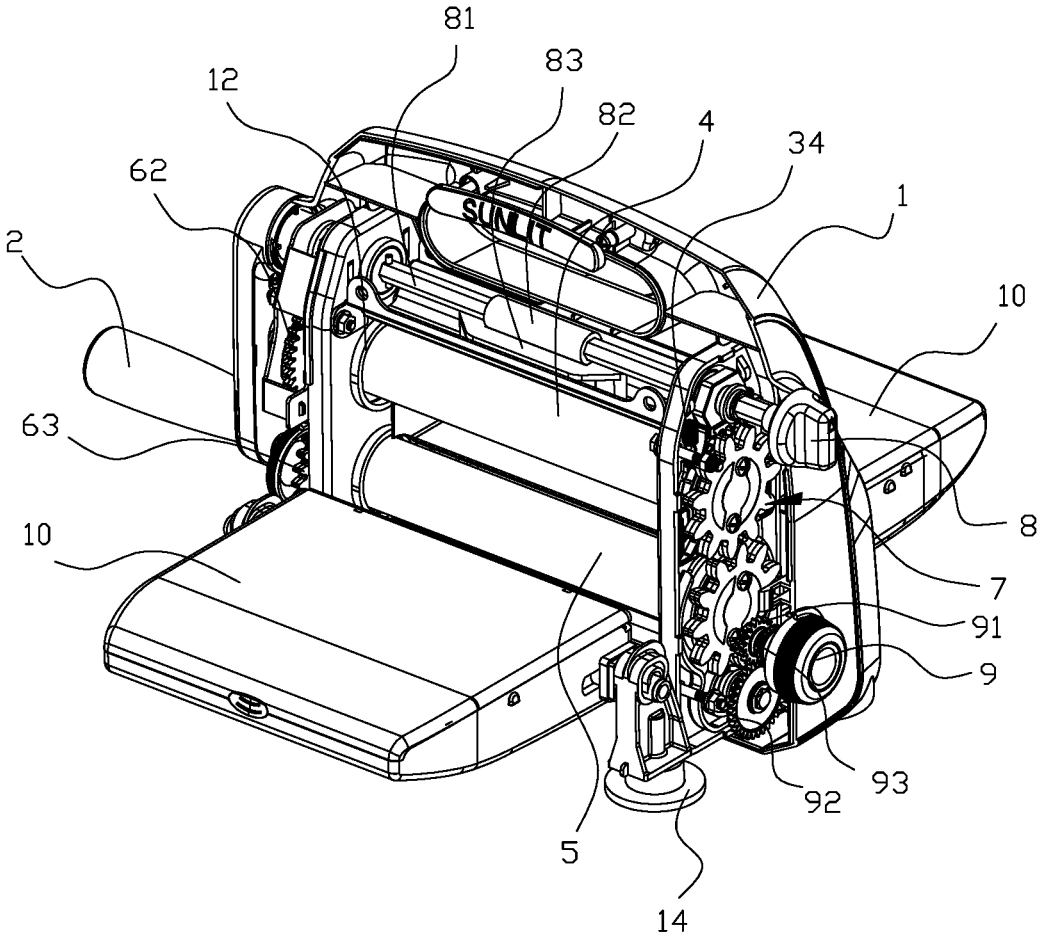
FIG. 3 is a perspective view of the manual craft cutting machine of the present invention (seen from the direction opposite to the handle, a half of the housing is removed)
Figure 5:
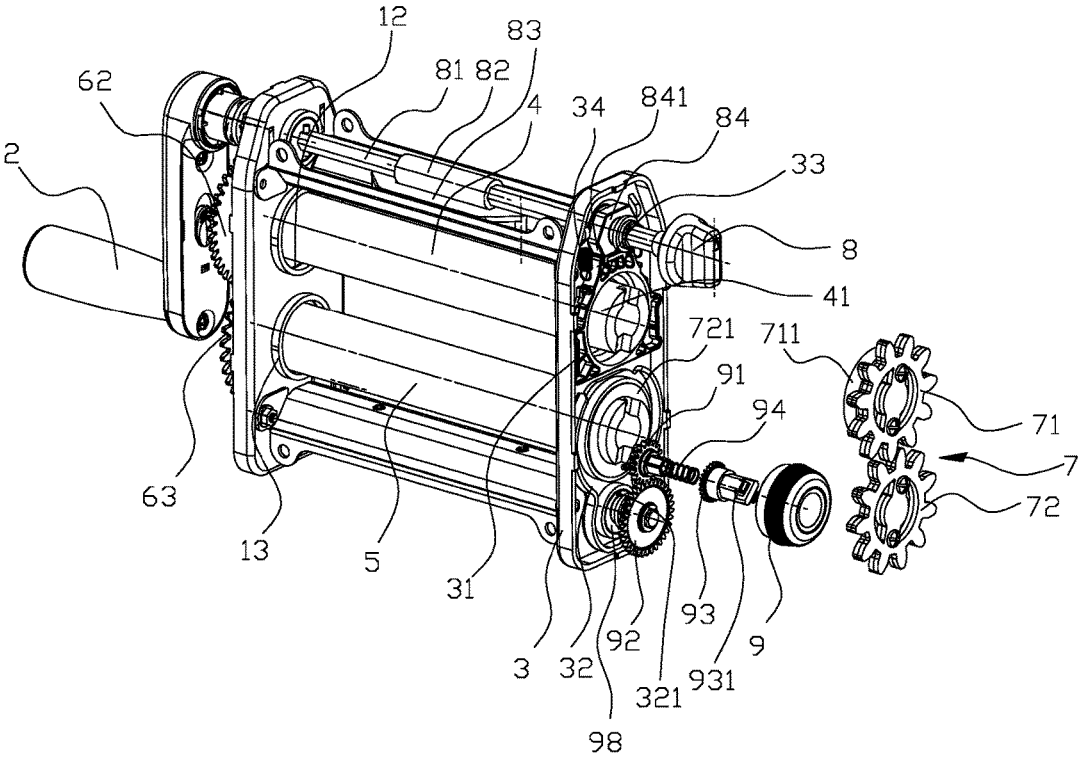
FIG. 5 is an exploded view of the manual craft cutting machine of the present invention (seen from the direction opposite to the handle, the housing is removed)

Further, as shown in FIGS. 2, 3, and 5, a shift adjustment shaft support seat is provided between the two ends of the shift adjustment shaft 81. The shift adjustment shaft support seat includes a shift adjustment shaft support bearing 82 and a bearing seat 83. The shift adjustment shaft support bearing 82 is sleeved on the outside of the shift adjustment shaft 81. The bearing seat 83 is a bearing bush structure formed by a curved groove. The outer curved surface of the shift adjustment shaft support bearing 82 is embedded in the bearing seat 83 and supported by the bearing seat 83, so that the shift adjustment shaft does not bend due to excessive stress when the press rollers are working.

Furthermore, as shown in FIGS. 3 and 5, a return spring 34 is provided between the positioning retainer and the first sliding retainer 31, so that the shift key surface 841 and the shift driven key surface are always in stable contact with each other.

Figure 4:
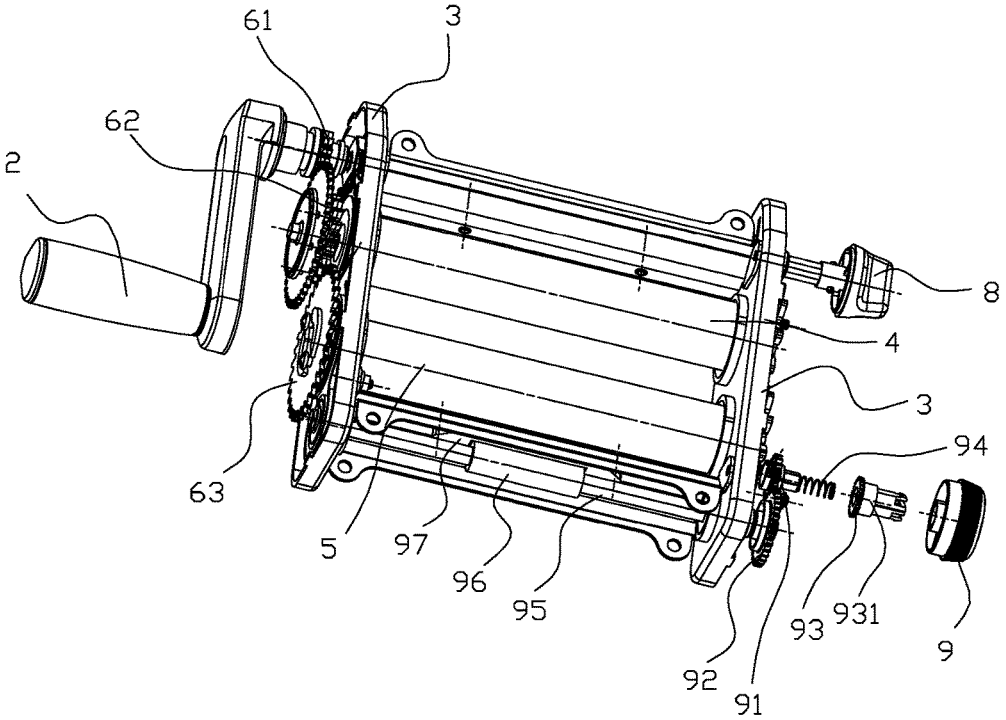
FIG. 4 is a perspective view of the manual craft cutting machine of the present invention (seen from the direction of the handle, the housing is removed)

As shown in FIGS. 3, 4 and 5, the fine adjustment mechanism includes a fine adjustment knob 9, a fine adjustment shaft 95, and a fine adjustment turning wheel 98. The fine adjustment shaft 95 is parallel to the second press roller 5. The fine adjustment turning wheel 98 is sleeved and fixed on the two ends of the fine adjustment shaft 95 and rotated along with the fine adjustment shaft 95. The center axis of the fine adjustment turning wheel 98 is deviated from the axis of the fine adjustment shaft 95. The deviated distance corresponds to the fine adjustment distance of the press rollers. The second sliding retainer 32 is provided with a fine adjustment tuning wheel hole 321 for mounting the fine adjustment tuning wheel 98. The fine adjustment shaft 95 is driven by the fine adjustment knob 9 to rotate. The fine adjustment tuning wheel 98 drives the second sliding retainer 32 to move, corresponding to the slight distance change between the press rollers.

As shown in FIGS. 3, 4, and 5, the fine adjustment mechanism further includes a fine adjustment gear set. The fine adjustment gear set includes a pair of a fine adjustment gear 92 and a fine adjustment pinion 91 to mesh with each other. The fine adjustment gear 92 is fixedly connected with the fine adjustment shaft 95. The fine adjustment pinion 91 is connected with the positioning retainer 3 (or fixedly connected with the housing), so that the fine adjustment knob 9 reduces the force when the fine adjustment shaft 95 is driven, thereby improving the feeling of fine adjustment.

Furthermore, as shown in FIGS. 3, 4 and 5, a fine adjustment shaft support seat is provided between the two ends of the fine adjustment shaft 95. The fine adjustment shaft support seat includes a fine adjustment shaft support bearing 96 and a bearing seat 97. The fine adjustment shaft support bearing 96 is sleeved on the outside of the fine adjustment shaft 95. The bearing seat 97 is a bearing bush structure formed by a curved groove. The outer curved surface of the fine adjustment shaft support bearing 96 is embedded in the bearing seat 97 and supported by the bearing seat 97, so that the fine adjustment shaft does not bend due to excessive stress when the press rollers are working.

Further, as shown in FIGS. 3, 4 and 5, the fine adjustment knob 9 is provided with a locking gear 93. A sleeve 931 is axially disposed on the locking gear 93. One end of the sleeve 931 is axially connected and locked to the fine adjustment knob 9. The axle of the fine adjustment pinion 91 is fitted in the sleeve 931. The fine adjustment pinion 91 and the locking gear 93 are coaxially connected. The positioning retainer (or the housing) is provided with a fine adjustment locking groove (not shown in the figures). The shape of the fine adjustment locking groove is matched with the locking gear 93. A push spring 94 is provided in the sleeve 931. When the fine adjustment knob 9 is adjusted, the fine adjustment knob 9 compresses the push spring 94 and the fine adjustment knob 9 pushes the locking gear 93 to move axially, so that the locking gear 93 is detached from the fine adjustment locking groove to be unlocked. At this time, the fine adjustment shaft 95 can be rotated to adjust the second press roller 5. When the adjustment is completed, the fine adjustment knob 9 is released. Under the driving force of the push spring 94, the locking gear 93 slides axially along with the fine adjustment knob 9 and is inserted in the fine adjustment locking groove again so that the second press roller 5 is kept in a locked state.

As shown in FIGS. 2, 3, 4, and 5, the gears of the speed reduction gear set and the constant speed gear set are formed by stamping a thin metal plate. The gear may be formed by two separately stamped gears which are superimposed and connected (more superimposition may be performed as needed), so that the cost of the gear can be lowered while meeting performance requirements.

The present invention is provided with the positioning retainer 3, the sliding retainer, the shift adjustment mechanism and the fine adjustment mechanism. The press rollers are fixed on the sliding retainer, and the spacing between the press rollers can be adjusted through the shift adjustment mechanism and the fine adjustment mechanism to meet the specific requirements of various pattern mediums and pattern making, improving the efficiency of pattern making, reducing the cost of production tools, and improving the cleanness of the production environment.

Figure 7:
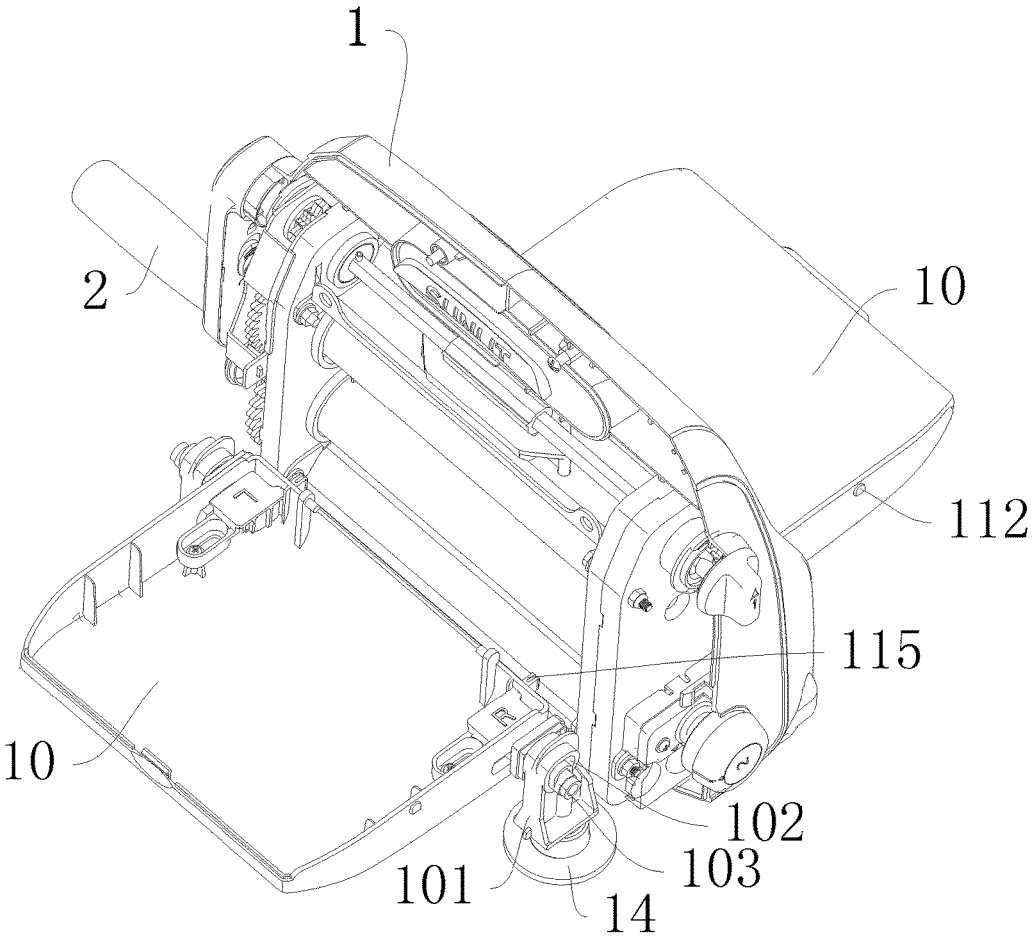
FIG. 7 is a schematic view showing the connection of the support legs of the manual craft cutting machine of the present invention.

Furthermore, as shown in FIG. 7, the bottom of the housing 1 is provided with support legs 14. Each support leg 14 includes a suction cup that can be moved up and down. The upper portion of the suction cup is fixedly provided with a connecting seat 101. The connecting seat 101 is disposed inside the housing 1. One end of the connecting seat 101 is provided with a shaft hole 102. The shaft hole 102 is provided with a camshaft 103. The conveying plate 10 is rotatably connected to the housing 1 through the camshaft 103. The connecting seat 101 is moved up and down along with rotation of the camshaft 103. In a working state, the conveying plate 10 is turned to a horizontal position, and the camshaft 103 presses the connecting seat 101 and the suction cup downward, so that the suction cup is to press the ground. The air in the suction cup is exhausted so that the suction cup is firmly adhered to the ground to improve the working stability of the apparatus. When not in use, the conveying plate 10 is turned from the horizontal position to a vertical position, the camshaft 103 is rotated to move the connecting seat 101 and the suction cup upward, such that the suction cup is moved away the ground to lift the apparatus easily.

Figure 6:
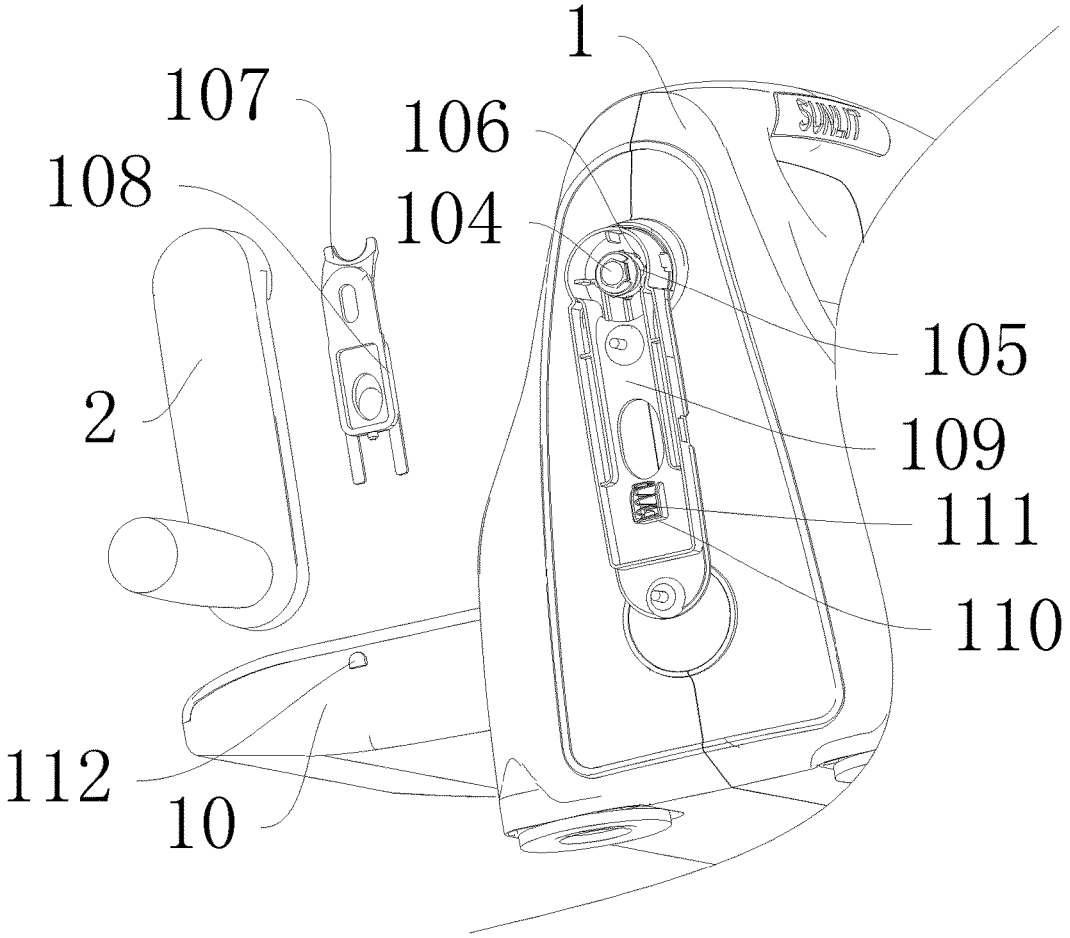
FIG. 6 is an exploded view of the handle of the manual craft cutting machine of the present invention.

In addition, as shown in FIG. 6, the handle gear 61 is provided with a connecting shaft 104 which is fitted and fixed to the handle 2. The side wall of the connecting shaft 104 is provided with an annular engaging groove 105 and an axial rib 106. The handle 2 is fitted on the connecting shaft 104 and engaged with the axial rib 106 to achieve synchronous rotation. The handle 2 is provided with an axial locking device to be engaged with the annular engaging groove 105. The axial locking device comprises an engaging plate 107 which is inserted into and removed from the annular engaging groove 105 and a push button 108 for controlling the movement of the engaging plate. The push button 108 is integrally formed with the engaging plate 107. The push button 108 is disposed on the outer wall of the handle 2 and can be moved back and forth. The handle 2 has a positioning groove 109 therein. The engaging plate 107 is moved back and forth within the positioning groove 109. A baffle 110 perpendicular to the direction of movement of the engaging plate is provided in the positioning groove 109. A restoring spring 111 is provided between the engaging plate 107 and the baffle 110. In the natural state, the engaging plate 107 is biased by the restoring spring 111 to be engaged with the annular engaging groove 105. The handle 2 is not easy to fall off under normal use. When not in use, the push button 108 is pushed to disengage the engaging plate 107 from the annular engaging groove 105. The handle 2 is moved in the axial direction of the connecting shaft 104 to separate the handle 2 from the connecting shaft 104. It is convenient for disassembly and assembly and replacement.

Figure 8:
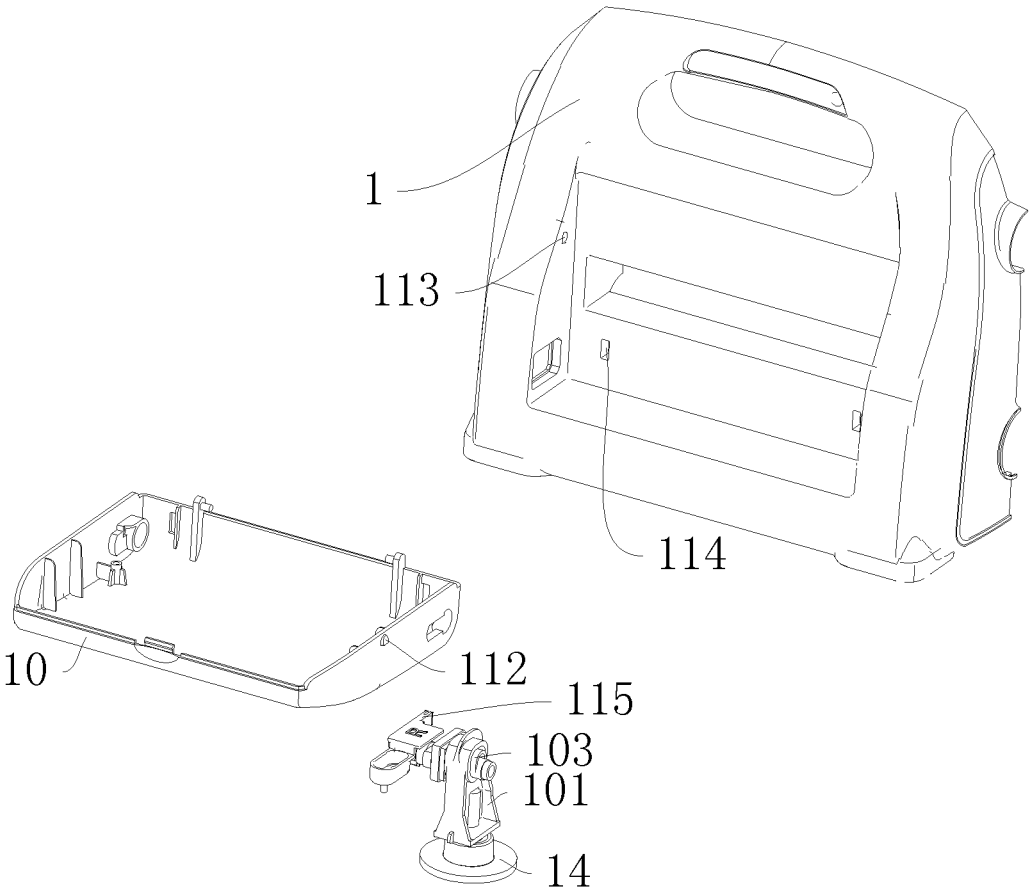
FIG. 8 is an exploded view showing the connecting portion of the conveying plate and the housing of the manual craft cutting machine of the present invention (the upper portion of the conveying plate is removed)

As shown in FIG. 8, two side walls of each conveying plate 10 are provided with protrusions 112. The housing 1 is provided with engaging recesses 113 corresponding to the protrusions 112. When the craft cutting machine is not used, the conveying plates 10 are turned to the vertical position and are in contact with the housing 1. The protrusions 112 are engaged with the engaging recesses 113 to lock the conveying plates 10, so that the conveying plates 10 won't rotate automatically. The storage is convenient, the connection is stable, and the service life is long.

Figure 9:
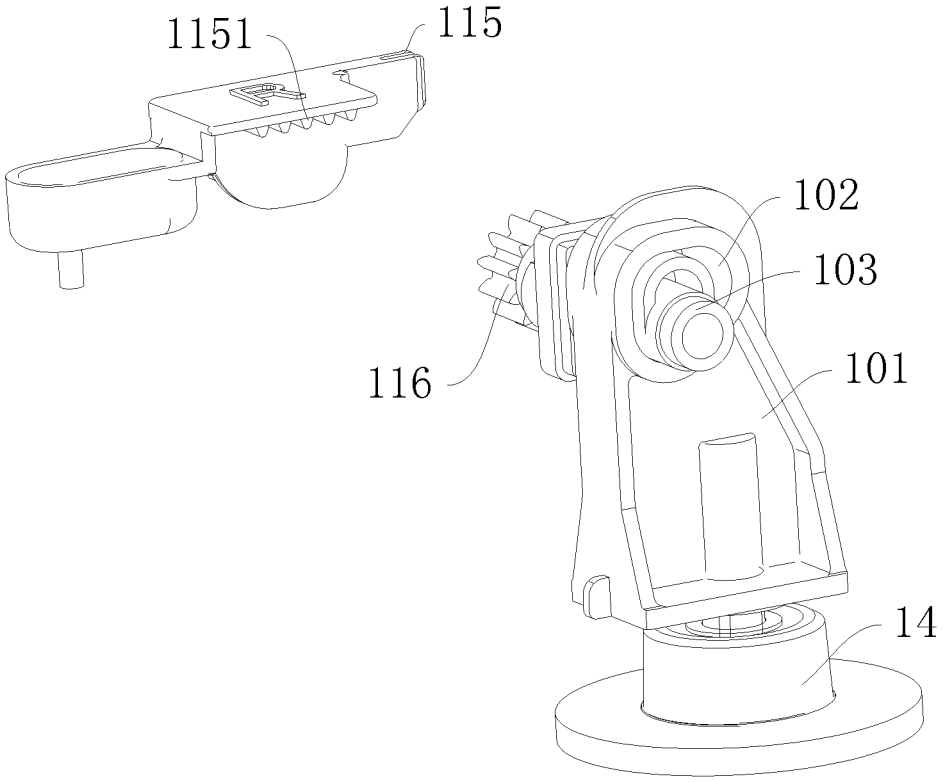
FIG. 9 is an exploded view of the gear rack and the gear shaft of the manual craft cutting machine of the present invention.

As shown in FIGS. 8 and 9, the bottom of each conveying plate 10 is provided with a retractable buckle 115. The side wall of the housing 1 is formed with a buckle hole 114 for engaging with the buckle 115. When the conveying plate 10 is in the horizontal position, the buckle 115 extends out of the outer wall of the conveying plate 10 to be engaged in the buckle hole 114 so that the conveying plate 10 is locked at the horizontal position. When in use, the conveying plate 10 won't be turned easily so as to improve the connection stability between the conveying plate 10 and the housing 1 for the user to use the craft cutting machine. The buckle 115 is integrally formed with a gear rack 1151 located inside the conveying plate 10. The inside of the conveying plate 10 is provided with a gear shaft 116 located at the rotation axis and meshed with the gear rack 1151. When the conveying plate 10 is in the vertical position, the buckle 115 is located in the conveying plate 10. When the conveying plate 10 is turned from the vertical position to the horizontal position, the gear rack 1151 meshes with the gear shaft 116, and the buckle 115 gradually extends out of the conveying plate 10 until it is engaged in the buckle hole 114 to lock the conveying plate 10. When the craft cutting machine is not used, the conveying plate 10 is turned, the gear rack 1151 meshes with the gear shaft 116, and the buckle 115 is retracted into the conveying plate 10. The present invention has the advantages of compact structure and stable connection, which is beautiful and practical.

The foregoing descriptions of specific exemplary embodiments of the present invention have been presented for the purposes of illustration and description. These descriptions do not intend to limit the invention to the precise form disclosed. It is obvious that many changes and modifications are possible based on the above teachings. The purpose of selecting and describing the exemplary embodiments is to explain the specific principles of the invention and its practical application so that those skilled in the art will be able to implement and use various different exemplary embodiments and various alternatives and changes of the present invention. Various modifications and enhancements may be made without departing from the spirit and scope of the present invention. Accordingly, the present invention is not to be limited except as by the appended claims.

What is claimed is:

1. A manual craft cutting machine, comprising a housing (1), a template, a press roller, a retainer, a backing plate and a drive mechanism; the template including a pair of upper and lower templates, a pattern medium being sandwiched between the upper and lower templates; the press roller being composed of a pair of a first press roller (4) and a second press roller (5), the press rollers being disposed axially parallel to each other, two ends of the press roller forming a roller axle (41) or extending in an axial direction of the press roller to form the roller axle (41), the roller axle (41) being confined by the retainer, the backing plate being composed of a pair of backing plates attached to each other and sandwiched between the press rollers, the template being sandwiched between the backing plates; characterized in that:

the retainer comprises a positioning retainer (3) and a sliding retainer, the positioning retainer (3) is tightly connected with the housing (1) and disposed at the two ends of the press roller, the positioning retainer (3) is provided with a slide groove; the sliding retainer is inserted in the slide groove and movable along the slide groove, the sliding retainer comprises a first sliding retainer (31) rotatably connected with the first press roller (4) and a second sliding retainer (32) rotatably connected with the second press roller (5);

the drive mechanism includes a handle (2) and a gear set; the gear set includes a speed reduction gear set (6) and a constant speed gear set (7), the speed reduction gear set (6) includes a handle gear (61), a speed reduction gear or the speed reduction gear set (6) to mesh with each other, the handle gear (61) is rotated along with the handle (2), the speed reduction gear is connected with the first press roller (4) or the second press roller (5) to drive one of the two press rollers to rotate; the constant speed gear set (7) includes a pair of a first constant speed gear (71) and a second constant speed gear (72) to mesh with each other, the constant speed gears are fixed on the roller axles of the first press roller (4) and the second press roller (5) respectively, when one of the press rollers is driven by the speed reduction gear to rotate, the other press roller is driven by the constant speed gear to rotate at a constant speed;

the manual craft cutting machine further comprises a press roller spacing adjustment mechanism, the press roller spacing adjustment mechanism comprises a shift adjusting mechanism for adjusting a large spacing between the press rollers and a fine adjustment mechanism for adjusting a fine spacing between the press rollers, the shift adjustment mechanism drives the first sliding retainer (31) to move along the slide groove, the fine adjustment mechanism drives the second sliding retainer (32) to move along the slide groove.

2. The manual craft cutting machine as claimed in claim 1, wherein the shift adjustment mechanism includes a shift adjustment knob (8), a shift adjustment shaft (81) and a shift driving key (84), the shift adjustment shaft (81) is parallel to the first press roller (4), the shift driving key (84) is fitted and fixed on two ends of the shift adjustment shaft (81) and rotated along with the shift adjustment shaft (81), the shift driving key (84) has shift key surfaces (841), the number of the shift key surfaces (841) is two, axial distances between the different shift key surfaces (841) and the shift adjustment shaft (81) are different; the first sliding retainer (31) at two ends of the first press roller (4) is provided with a corresponding shift driven key (33), the shift driven key (33) has a corresponding shift driven key surface, when the shift adjustment knob (8) is rotated, the shift adjustment shaft (81) is driven to rotate; and abutting surfaces of the shift key surface (841) and the shift driven key surface generate a change.

3. The manual craft cutting machine as claimed in claim 2, wherein a shift adjustment shaft support seat is provided between the two ends of the shift adjustment shaft (81).

4. The manual craft cutting machine as claimed in claim 2, wherein the shift driven key (33) is separately provided and embedded in a surface of the first sliding retainer (3).

5. The manual craft cutting machine as claimed in claim 2, wherein the positioning retainer (3) is a paired housing structure, side walls at both sides of the housing structure are vertical structures, and the side walls form the slide groove.

6. The manual craft cutting machine as claimed in claim 5, wherein a return spring (34) is provided between the positioning retainer and the first sliding retainer (31).

7. The manual craft cutting machine as claimed in claim 2, wherein the fine adjustment mechanism includes a fine adjustment knob (9), a fine adjustment shaft (95) and a fine adjustment turning wheel (98), the fine adjustment shaft (95) is parallel to the second press roller (5), the fine adjustment turning wheel (98) is sleeved and fixed on two ends of the fine adjustment shaft (95) and rotated along with the fine adjustment shaft (95), a center axis of the fine adjustment turning wheel (98) is deviated from an axis of the fine adjustment shaft (95), and the second sliding retainer (32) is provided with a fine adjustment tuning wheel hole (321) for mounting the fine adjustment tuning wheel (98).

8. The manual craft cutting machine as claimed in claim 7, wherein the fine adjustment mechanism further includes a fine adjustment gear set, the fine adjustment gear set includes a pair of a fine adjustment gear (92) and a fine adjustment pinion (91) to mesh with each other, the fine adjustment gear (92) is fixedly connected with the fine adjustment shaft (95), and the fine adjustment pinion (91) is connected with the housing (1) or the positioning retainer (3).

9. The manual craft cutting machine as claimed in claim 8, wherein a fine adjustment shaft support seat is provided between the two ends of the fine adjustment shaft (95).

10. The manual craft cutting machine as claimed in claim 9, wherein the fine adjustment knob (9) is provided with a locking gear (93), a sleeve (931) is axially disposed on the locking gear (93), one end of the sleeve (931) is axially connected to the fine adjustment knob (9), an axle of the fine adjustment pinion (91) is fitted in the sleeve (931), the fine adjustment pinion (91) and the locking gear (93) are coaxially connected, the housing (1) or the positioning retainer (3) is provided with a fine adjustment locking groove, the fine adjustment locking groove has a shape matched with the locking gear (93), and a push spring (94) is provided in the sleeve (931).

11. The manual craft cutting machine as claimed in claim 7, wherein the fine adjustment mechanism further includes a fine adjustment gear set, the fine adjustment gear set includes a pair of a first adjustment gear and a second adjustment gear to mesh with each other, the first fine adjustment gear is fixedly connected with the fine adjustment shaft (95), and the second adjustment gear is connected with the housing (1) or the positioning retainer (3).

12. The manual craft cutting machine as claimed in claim 2, wherein the gears of the speed reduction gear set and the constant speed gear set are formed by stamping a thin metal plate.

13. A manual craft cutting machine, comprising a housing (1), a press roller, a retainer and a drive mechanism; the press roller being composed of a pair of a first press roller (4) and a second press roller (5), the press rollers being disposed axially parallel to each other, two ends of the press roller forming a roller axle (41) or extending in an axial direction of the press roller to form the roller axle (41), the roller axle (41) being confined by the retainer, characterized in that:

the retainer comprises a positioning retainer (3) and a sliding retainer, the positioning retainer (3) is tightly connected with the housing (1); the positioning retainer (3) is provided with a slide groove; the sliding retainer is inserted in the slide groove and movable along the slide groove, the sliding retainer comprises a first sliding retainer (31) rotatably connected with the first press roller (4) and a second sliding retainer (32) rotatably connected with the second press roller (5);

the drive mechanism includes a handle (2) and a gear set; the gear set includes a speed reduction gear set (6) and a constant speed gear set (7), the speed reduction gear set (6) includes a handle gear (61) and a speed reduction gear to mesh with each other, the handle gear (61) is rotated along with the handle (2), the speed reduction gear is connected with the first press roller (4) or the second press roller (5) to drive one of the two press rollers to rotate; the constant speed gear set (7) includes a pair of a first constant speed gear (71) and a second constant speed gear (72) to mesh with each other, the constant speed gears are fixed on the roller axles (41) of the first press roller (4) and the second press roller (5) respectively, when one of the press rollers is driven by the speed reduction gear to rotate, the other press roller is driven by the constant speed gear to rotate at a constant speed;

the manual craft cutting machine further comprises a press roller spacing adjustment mechanism, the press roller spacing adjustment mechanism comprises a shift adjusting mechanism for adjusting a large spacing between the press rollers and a fine adjustment mechanism for adjusting a fine spacing between the press rollers, the shift adjustment mechanism drives the first sliding retainer (31) to move along the slide groove, the fine adjustment mechanism drives the second sliding retainer (32) to move along the slide groove.

14. The manual craft cutting machine as claimed in claim 13, further comprising one or more backing plates attached to each other, the backing plate being sandwiched between the first press roller (4) or the second press roller (5).

15. The manual craft cutting machine as claimed in claim 13, wherein the shift adjustment mechanism includes a shift adjustment knob (8), a shift adjustment shaft (81) and a shift driving key (84), the shift adjustment shaft (81) is parallel to the first press roller (4), the shift driving key (84) is sleeved and fixed on two ends of the shift adjustment shaft (81) and rotated along with the shift adjustment shaft (81), the shift driving key (84) has more than two shift key surfaces (841), axial distances between the different shift key surfaces (841) and the shift adjustment shaft (81) are different; the first sliding retainer (31) at two ends of the first press roller (4) is provided with a corresponding shift driven surface, when the shift adjustment knob (8) is rotated, the shift adjustment shaft (81) is driven to rotate; and abutting surfaces of the shift key surface (841) and the shift driven surface generate a change.

16. The manual craft cutting machine as claimed in claim 1 or 13, wherein two sides of the housing (1) are provided with conveying plates (10), and the conveying plates (10) are rotatably connected with the housing (1).

17. The manual craft cutting machine as claimed in claim 16, wherein a bottom of the housing (1) is provided with support legs (14), the support legs (14) each include a suction cup that can be moved up and down; an upper portion of the suction cup is fixedly connected with a connecting seat (101), the connecting seat (101) is disposed inside the housing (1); one end of the connecting seat (101) is provided with a shaft hole (102), the shaft hole (102) is provided with a camshaft (103), the conveying plates (10) are rotatably connected to the housing (1) through the camshaft (103); the connecting seat (101) and the suction cup are moved up and down along with rotation of the camshaft (103).

18. The manual craft cutting machine as claimed in claim 1 or 13, wherein the handle gear (61) is provided with a connecting shaft (104) which is fitted and fixed to the handle (2), a side wall of the connecting shaft (104) is provided with an annular engaging groove (105); the handle (2) is provided with an axial locking device to be engaged with the annular engaging groove (105), the axial locking device comprises an engaging plate (107) which is inserted into and removed from the annular engaging groove (105) and a push button (108) for controlling movement of the engaging plate (107), and the push button (108) is disposed on an outer wall of the handle (2) and can be moved back and forth.

19. The manual craft cutting machine as claimed in claim 18, wherein the handle (2) has a positioning groove (109) therein, the engaging plate (107) is moved back and forth within the positioning groove (109); a baffle (110) perpendicular to the direction of movement of the engaging plate (107) is provided in the positioning groove (109), a restoring spring (111) is provided between the engaging plate (107) and the baffle (110); in a natural state, the engaging plate (107) is engaged with the annular engaging groove (105).

* * * * *